United States Patent [19]

Nicholls

[11] Patent Number: 4,808,972

[45] Date of Patent: Feb. 28, 1989

[54] SECURITY SYSTEM WITH FALSE ALARM INHIBITING

[75] Inventor: David Nicholls, Burwood, Australia

[73] Assignee: Cadin Electronics Pty. Ltd., Victoria, Australia

[21] Appl. No.: 55,151

[22] Filed: May 28, 1987

[30] Foreign Application Priority Data

May 29, 1986 [AU] Australia ..... PH6165

[51] Int. Cl.[4] ..... G08B 13/00; G08B 25/00; G08B 27/00

[52] U.S. Cl. ..... 340/541; 340/526; 340/636; 340/652; 340/691

[58] Field of Search ..... 340/526, 587, 510, 636, 340/691, 652, 540, 541

[56] References Cited

U.S. PATENT DOCUMENTS

| | | | |
|---|---|---|---|
| 3,713,128 | 1/1973 | Wong et al. | 340/526 |
| 3,828,338 | 8/1974 | Kato | 340/526 |
| 4,195,286 | 3/1980 | Galvin | 340/587 |
| 4,509,102 | 4/1985 | Ayer | 340/636 |
| 4,611,197 | 9/1986 | Sansky | 340/526 |

*Primary Examiner*—Glen R. Swann, III

*Attorney, Agent, or Firm*—Lane and Aitken

[57] ABSTRACT

A security system includes a plurality of sensors each capable of providing a detection input signal adapted to cause activation of the alarm system, a circuit for inhibiting activation of the alarm system as a result of a first detection input signal, and a circuit for removing the inhibition and allowing activation of the alarm system in response to a second detection input signal from any one of the sensors, including the sensor that provided the first detection input signal. A first alarm device is located essentially indoors on the premises to be protected and a second alarm device is located outdoors on the premises to be protected. The inhibition circuit allows activation of only the indoor alarm device, but a further detection input signal from one of the sensors within a predetermined time activates the outdoor alarm device.

13 Claims, 10 Drawing Sheets

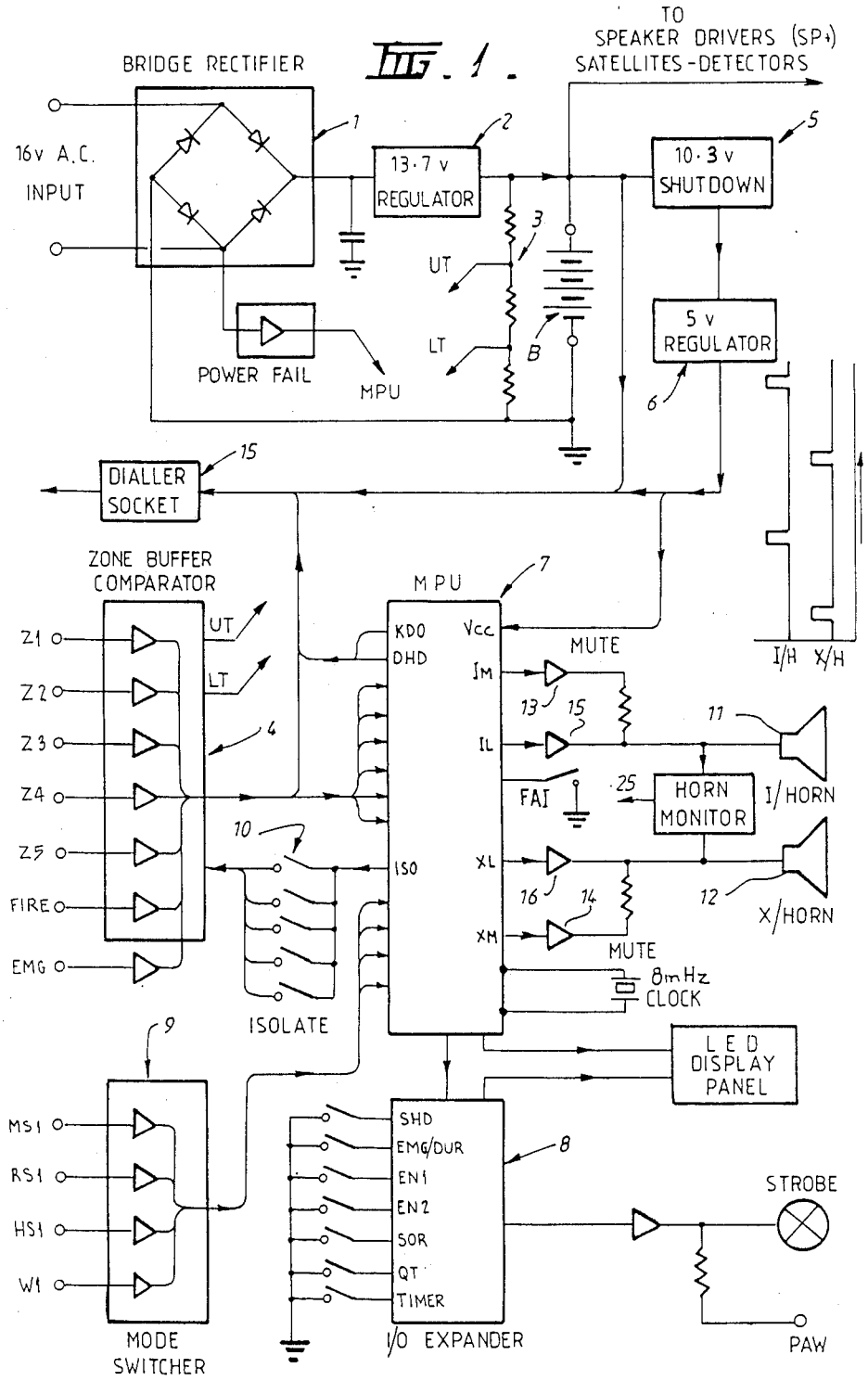
FIG. 1.
BRIDGE RECTIFIER
16v A.C. INPUT
13·7 v REGULATOR
10·3 v SHUTDOWN
TO SPEAKER DRIVERS (SP+) SATELLITES-DETECTORS
UT
LT
B
POWER FAIL
MPU
5 v REGULATOR
DIALLER SOCKET
ZONE BUFFER COMPARATOR
Z1
Z2
Z3
Z4
Z5
FIRE
EMG
UT
LT
MPU
KDO
DHD
ISO
Vcc
IM
IL
FAI
XL
XM
MUTE
I/H
X/H
HORN MONITOR
I/HORN
X/HORN
MUTE
8mHz CLOCK
ISOLATE
LED DISPLAY PANEL
MS1
RS1
HS1
W1
MODE SWITCHER
SHD
EMG/DUR
EN1
EN2
SOR
QT
TIMER
I/O EXPANDER
STROBE
PAW

SECURITY SYSTEM WITH FALSE ALARM INHIBITING

BACKGROUND OF THE INVENTION

Security alarm systems are now widely used to protect domestic and business premises. One of the major problems with security alarm systems is the occurrence of false alarms which result not only in annoyance to neighbors but may endanger lives if remote notification, usually by means of a telephone dialler, to police, security organizations or an owner is effected. False alarms may be so persistent that the owner becomes afraid or embarrassed to use the system thereby completely negating the primary function of the system.

False alarms are usually quite random in nature and may be caused by taxi radio signals, CB radio signals, amateur radio signals and other occurrences. Prior art attempts to reduce false alarms included the use of pulse counting techniques which allowed the alarm to sound only after a number of pulses caused by an intrusion or the like during a given time. This technique may be applied either at the control unit or at the detector but leads to a reduction in the overall security offered by the system, particularly if the detector has a low range or limited view of the area, thus allowing an intruder to enter without the alarm sounding. Pulse counters may also hide the problem of a faulty detector even with control units which "memory latch" previous alarms.

SUMMARY OF THE INVENTION

It is an object of the present invention to provide an improved alarm system in which the annoyance caused by false alarms is substantially reduced and which provides other features which improve the value of the alarm system to the user.

In one aspect therefore the invention provides an alarm system comprising means for receiving at least one detection input signal adapted to cause activation of the alarm system, means for inhibiting activation of said alarm system when a first detection input signal is received and means for removing said inhibition and allowing activation of said alarm system when another detection input signal is received within a predetermined time of said first detection input signal's being received.

In one embodiment, said alarm system includes a first alarm device adapted to be located essentially indoors on the premises to be protected, a second alarm device adapted to be located centrally outdoors on the premises to be protected, said inhibition means causing activation of said first alarm device only, said second alarm device being activated if a further detection input signal is received within said predetermined time.

In another embodiment of the invention, said alarm system includes means, such as a telephone dialler, adapted to transmit an alarm signal to a remote location, said transmitting means being inhibited when said first detection input is received and being activated when a further detection input signal is received indicating that a false alarm has not occurred.

In most cases, the alarm system will include at least the internal and external alarm devices, although some systems will include only a dialler or direct communication line without any alarm sounding devices.

In the present specification the term "alarm device" is intended to include sounding devices such as speaker horns, bells and the like, visual devices such as strobe lights and other special lighting systems, and combinations thereof.

It will be appreciated that the alarm system defined above has the advantage of confining any inconvenience caused by a false alarm to the interior of the premises protected by the alarm system whereby the least possible annoyance to neighbours results. If the alarm is also connected to a dialler, activation of the dialler occurs only when the second alarm device is activated, that is, only after a genuine alarm situation has been confirmed. However, it should be appreciated that the dialler aspect defined above may be used independently of the external alarm inhibition system. In other words a separate dialler inhibiting device may be attached to an existing alarm system to prevent the dialler's operating when a false alarm occurs.

The systems according to the present invention operate on the premise that false alarms are completely random in nature, occurring primarily as one-shot or single break occurrences, which are unlikely to be repeated within the predetermined period selected for detection of a further intrusion. The predetermined period may be selected according to the requirements of the system but would normally be of the order of five or ten minutes. Since the system will activate the external alarm means when a further intrusion is detected, a real alarm situation will be likely to be detected since any movement of the intruder during the timing period will cause the whole system to be activated.

The system preferably includes means for activating the dialler and/or the second alarm device in the event that the initiating trigger lasts for more than a predetermined period, for example, five to ten seconds, such as would occur in the case of cut wires, tampering and the like. Furthermore, the system preferably is arranged such that certain of the detection inputs bypass the inhibiting means and cause immediate activation of both alarm devices. Such inputs will usually include one shot devices such as mat sensors, narrow beam passive detectors, photoelectric detectors and the like, which are less prone to false claims.

Another source of false alarms occurs when the power supply to the alarm system is interrupted (or turned off) and the back-up battery voltage drops below the level at which the detectors will remain in the latched mode thereby causing a false alarm. In prior art alarm systems, there is no ability to deactivate the alarm system in the event that the power supply voltage drops below a predetermined level and in this situation a false alarm will always occur.

In another aspect, the invention provides a security alarm system in which a shut-down circuit is provided to deactivate the alarm system when the voltage of the back-up power supply drops below a predetermined voltage at which the alarm system will properly function.

In a preferred form of this aspect of the invention, a voltage comparator compares a reference voltage with the voltage at the mid point of a voltage divider connected across the back-up battery. When the voltage across the back-up battery drops below a predetermined voltage, for example, 10.3 volts, the output from the comparator goes low and causes the power supply to the alarm system to be turned off. In this way, the system is deactivated before the voltage drops to a level at which the various detectors will drop out due to insufficient voltage thereby avoiding another source of false alarms.

The alarm system also preferably includes the following features which are believed to improve the usefulness of the system to the user.

The system includes a mute button which reduces the voltage applied to the alarm horns and therefor the output from the horns for testing and for an initial familiarization period. In one form, the volume of the alarm horns is reduced to approximately one quarter of the normal volume.

The system further includes a home mode in which the alarm means are activated in the mute mode for an initial period, for example about thirty seconds, so that if the system has been inadvertently activated, it will not be as disturbing to the occupants of the premises or their neighbours.

The system also preferably includes provision for remote radio signal activation. In this mode of activation, an acknowledging signal is additionally transmitted from the external alarm means.

Another problem with existing alarm systems is the tendency for external alarm devices and control boxes to be disconnected or destroyed thereby aborting any alarm function. Although it is possible to overcome this problem by the use of so-called satellite siren units which contain a rechargeable battery and siren generator in the same container, a further source of false alarms will occur in the event that the mains supply is disconnected either due to power failure or other causes and the rechargeable battery gradually discharges to a voltage at which the siren will sound in the same way as if an attempt is made to disconnect or deactivate the satellite siren unit.

In a third aspect of the invention, there is provided a satellite alarm unit for a security system comprising an alarm means, power supply means and circuitry for detecting disconnection or tampering with said unit, and circuit means for detecting an abrupt change in the voltage supplied by the alarm control system to cause the alarm to be activated but which prevents activation of the alarm in the event that the voltage drops slowly, as would occur in the case of discharge of the remote power supply.

In a still further aspect of the invention there is provided an alarm system including first and second alarm devices which are activated on detection of an intrusion or other event, said alarm system being arranged so that the cyclic outputs from said first and second alarm devices are out of phase by a predetermined amount.

In one preferred form said outputs are in excess of 180° out of phase. This arrangement reduces the demand placed on the power supply and improves the power supply regulation of the alarm system by reducing the instantaneous drain on the power supply. The on/off ratio of each alarm device is also selected to facilitate better power supply regulation and is preferably selected so as to be about 1:7.

A preferred embodiment of this aspect of the invention will be described in greater detail below.

BRIEF DESCRIPTION OF THE DRAWINGS

A presently preferred form of the three aspects of the invention defined above will now be described with reference to the accompanying drawings in which:

FIG. 1 is a block diagram of an alarm system embodying the first and second aspects of the present invention;

DESCRIPTION OF THE PREFERRED EMBODIMENTS

Figure 2A:
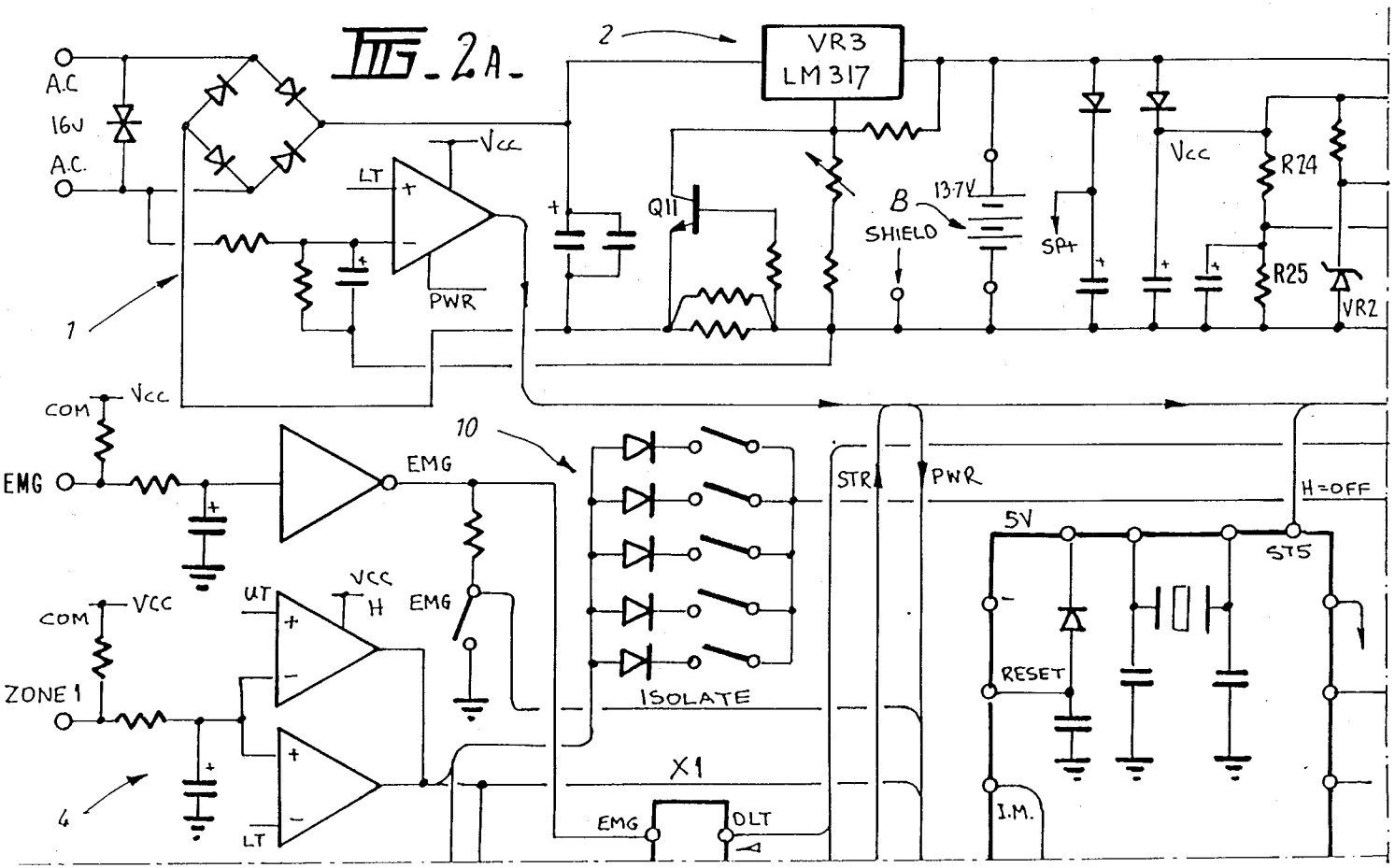
FIGS. 2A to 2F are a detailed circuit diagram of the alarm system of FIG. 1.
Figure 2B:
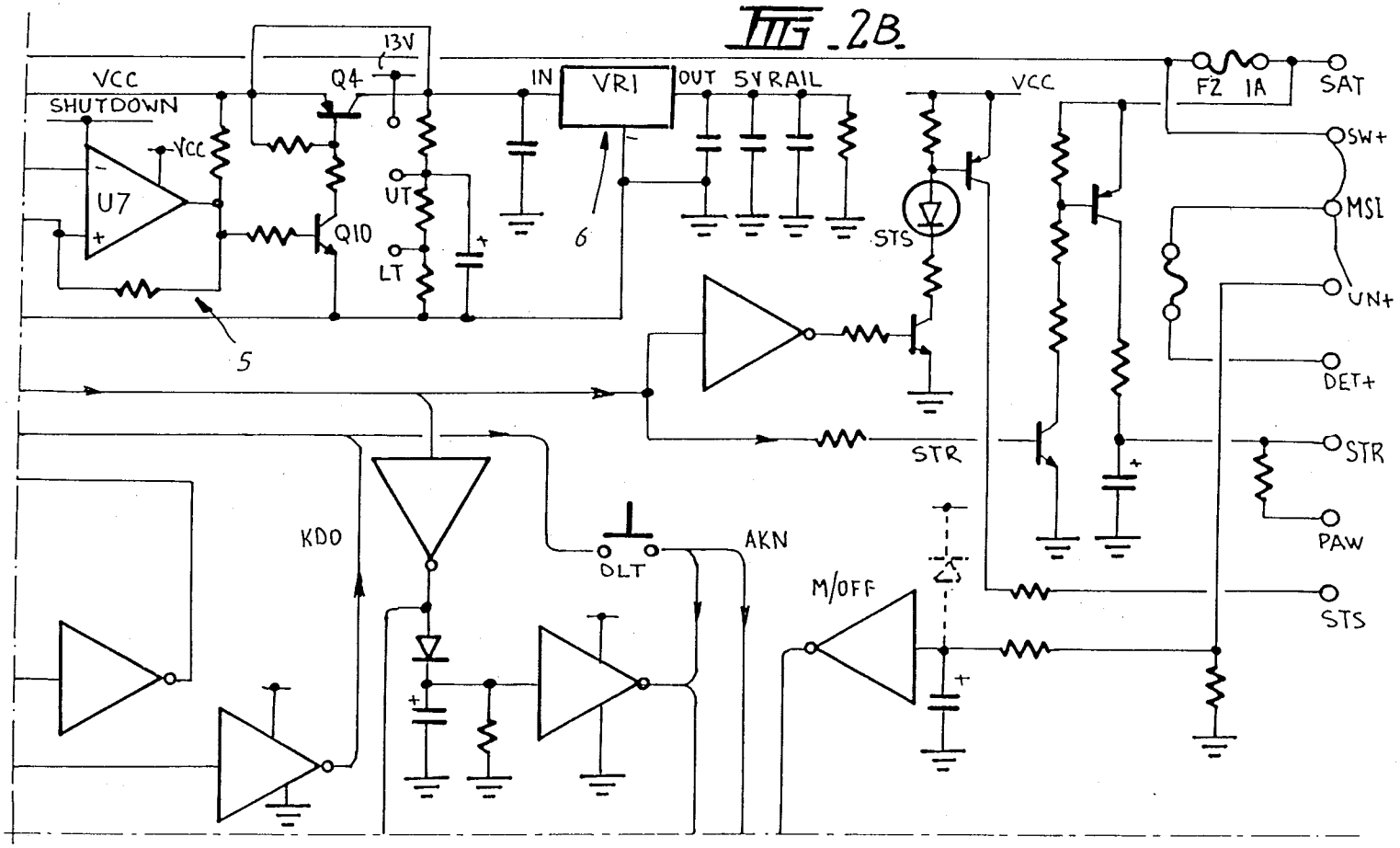
Figure 2C:
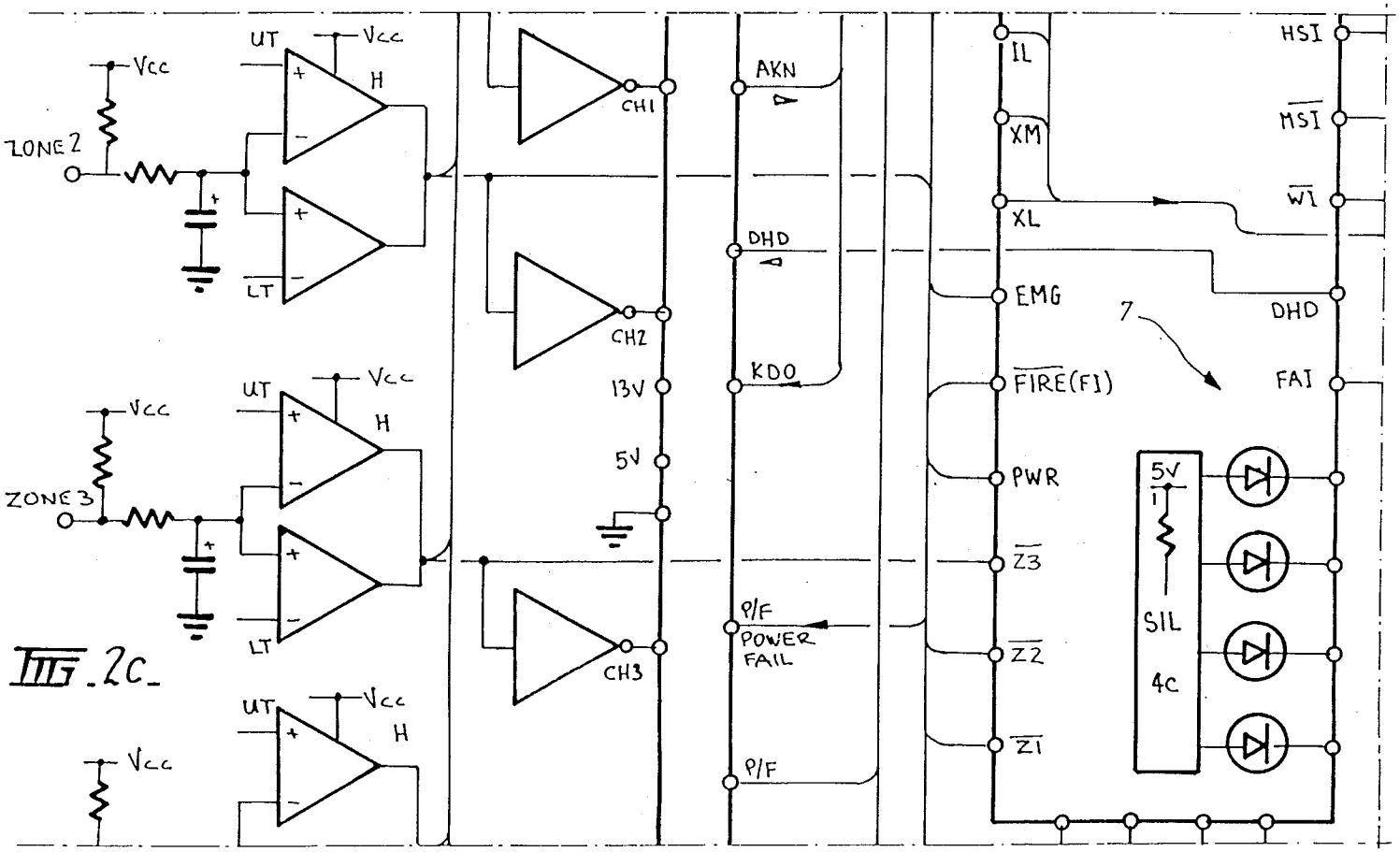
Figure 2D:
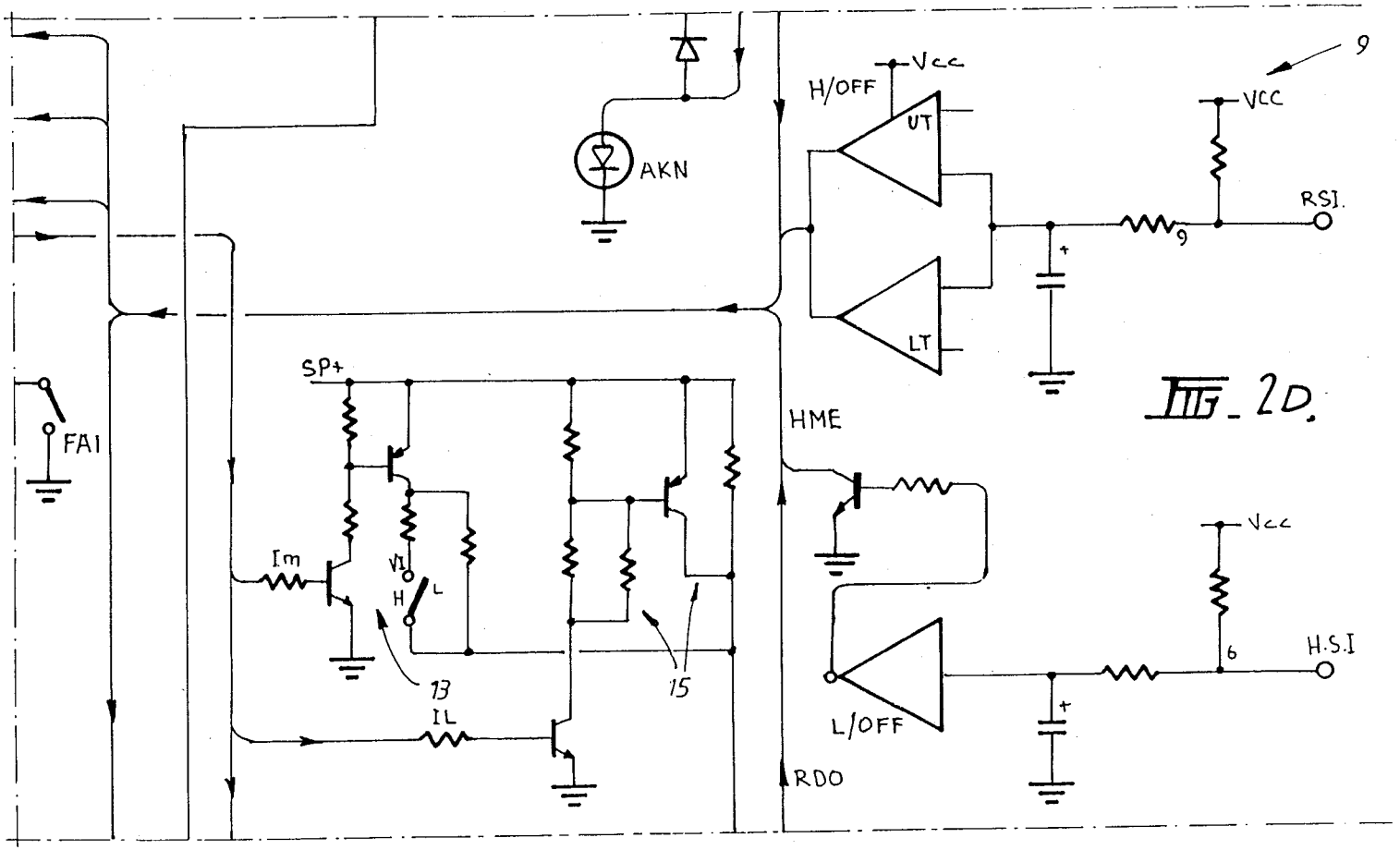
Figure 2E:
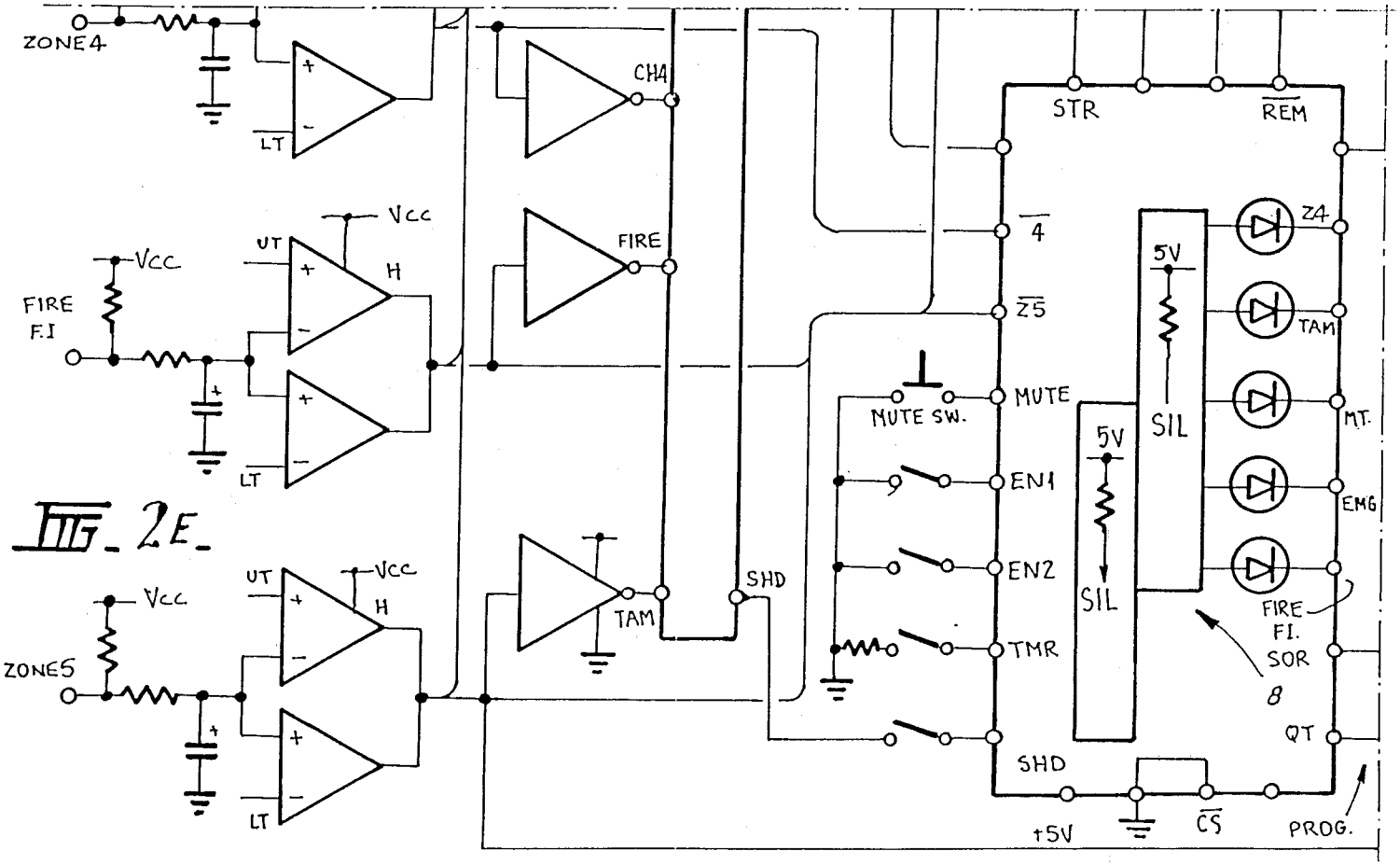
Figure 2F:
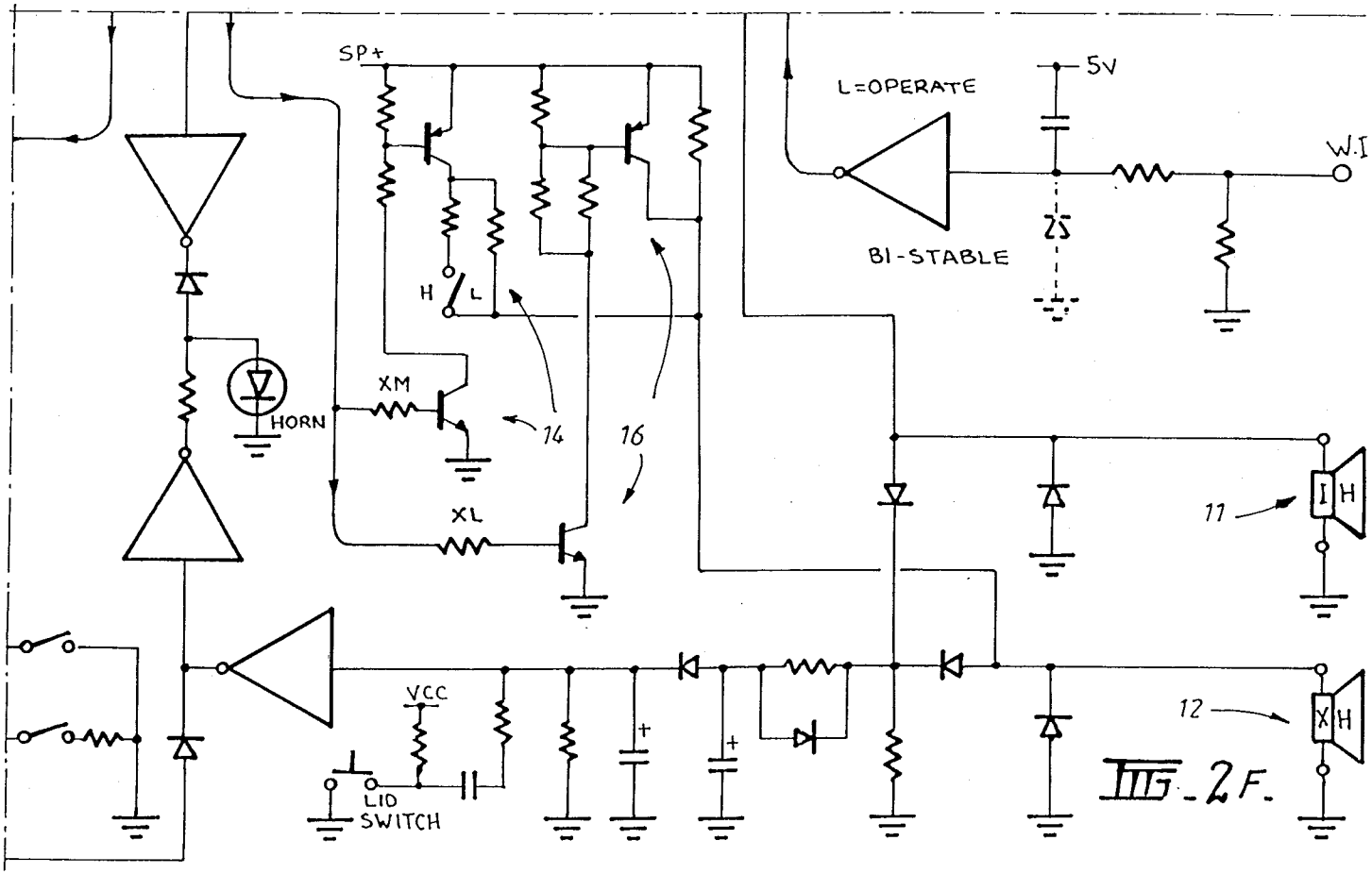

Referring firstly to the block diagram of FIG. 1 of the drawings, the alarm system will be seen to comprise a power supply section 1 to the output of which is connected a current limited voltage regulator 2 which is adapted to charge a stand-by battery (B) and provide a voltage source for the alarm system. A voltage divider network 3 provides upper trip UT and lower trip LT reference voltages which serve as controlling inputs for a zone buffer comparator 4. The output from the voltage regulator 2 is connected to a shut down switch circuit 5 which ensures that the alarm system does not remain operative when the supply voltage from the stand-by battery falls below a predetermined level, in the present embodiment, 10.3 volts. To ensure that the switch 5 does not repeatedly switch on and off as the current load from the battery during a power supply break causes the voltage to rise, the circuitry of the switch 5 incorporates voltage hysteresis of the order of 0.7 volt. A voltage regulator 6 is interposed between the shut down switch and the central micro-processor unit 7 and ancillary circuits.

The micro-processor unit 7 is programmed to control all timing, siren and announcement tones. LED driving and other switch selected functions. An in/out expander 8 is connected to the micro-processor unit 7 to expand the capability of the micro-processor unit 7.

A mode switching circuit 9 is also connected to the micro-processor unit 7 to allow selection of various modes of operation either at the main control panel, at one or more remote switches or by radio control.

The zone buffer/comparator circuit 4 includes inputs from five different zones to be protected and a fire input. Isolation switches 10 are provided to isolate any one of the five zones Z1 to Z5. In the present embodiment, zones Z4 and Z5 are reserved for use by one-shot devices such as detector mats, photo-electric devices, narrow beam passive detectors or the like.

Two separate alarm driving circuits are connected to the micro-processor unit 7. In the present embodiment, these circuits are connected to an internal alarm horn 11, which is adapted to be located within the premises to be protected, and an external alarm horn 12, which is located outside the premises to be protected. The alarm horns 11 and 12 are each provided with a muting circuit 13 and 14 respectively, which cause the alarm horn to operate at a considerably lower volume. The use of the mute function will be described further below.

When the internal and external alarm horns are sounding together a large demand is placed upon the power supply. To avoid the power supply regulation problems caused by this demand, the alarm horns 11 and 12 are driven by the microprocessor unit 7, so that their respective outputs are 180° out of phase, as shown in the timing diagram in FIG. 1. To further improve power supply regulation, the on/off ratio of each alarm horn signal is of the order of 1:7.

The micro-processor unit 7 is preferably in the form of a programmed read only memory (ROM) which is suitably programmed to achieve the necessary functions. More particularly, the ROM is programmed to incorporate a false alarm inhibition function which is designed to reduce the inconvenience of false alarms to the user. This function works on the premise that false alarms are completely random in nature and often appear as one-shot or single break occurrences. The micro-processor unit 7 is therefore programmed so that a first trigger from one of zones Z1, Z2 or Z3 causes actuation of the internal alarm horn 11 only, and if a further trigger is received from any one of zones Z1, Z2 or Z3 or from Z4 or Z5, both of the alarm horns 11 and 12 will be activated. If no further trigger is received by the micro-processor unit 7, the internal alarm horn 11 will be deactivated after a predetermined time, for example, 5 or 10 minutes as desired, thereby causing only limited disturbance to neighbours. It will be appreciated that the initial limitation of the alarm to the internal alarm horn 11 would not reduce the deterrent effect if an intruder has just entered the premises since the intruder will not be aware that only the internal alarm horn has sounded. In the event that the first trigger is longer than a predetermined period, say 10 seconds, as would be caused by cut wires, a broken window tape or the like, or if either of zones Z4 or Z5 is activated, both alarm horns 11 and 12 will be activated.

In the event that the alarm system is connected to a telephone dialling device via socket 15, the micro-processor unit 7 activates the dialler hold control voltage output to inhibit the dialler when only the internal alarm horn 11 has been activated. In the event that both the internal and the external alarm horns 11 and 12 are activated, the dialler will be activated also. It will be appreciated that the dialler hold function prevents an alarm message being transmitted to a remote position in the event that a false alarm occurs.

As an alternative to the above mode of operation, the micro-processor unit 7 may be programmed such that the first time any one of zones Z1 to Z5 triggers an alarm, both the internal and external alarm horns 11 and 12 are activated, but any subsequent trigger from the first triggered zone after the alarm horn has stopped sounding, only the internal alarm horn 11 will be activated. It will be appreciated that even if all zones are triggered in a first intrusion, only the first to be triggered will lose the ability to sound both the internal and external alarm horns during any second intrusion. In this way, all zones have the ability to sound both alarm horns at least once during repeated intrusion attempts.

Referring now to FIG. 2 of the drawings, a more detailed circuit diagram of the block diagram of FIG. 1 is provided. Since much of the circuitry shown will be self-explanatory to a person of skill in the art, only certain parts of the circuitry will be described in greater detail.

The power supply circuitry 1 will be seen to comprise a full wave bridge rectifier, the output from which is filtered and regulated by an LM317 three terminal regulator. A current limiting transistor Q11 is used to control the current output of the LM317 to one amp. The back-up battery B is positioned to be float charged at all times.

The shut-down circuit 5 will be seen to comprise a voltage divider network R24, R24 to the mid point of which is connected the positive terminal of a voltage comparator U7. The negative terminal of the voltage comparator U7 is connected to a zener diode VR2 which provides a reference voltage of the order of 5.1 V. The mid point of the voltage divider is normally at a voltage of 6.5 V but in the event that the output from the back-up battery B falls below 5.1 V, the output from the comparator U7 goes low thereby turning transistor Q10 off which in turn turns transistor Q4 off, shutting off the power supply to the voltage regulator 6 and deactivating the micro-processor unit 7.

The zone buffer/comparator 4 incorporates end of line resistors at the remote ends of zones 1 to 5 and fire and provided that the voltage across these resistors is within the limits set by the comparators receiving the upper trip and lower trip reference voltages UT and LT, then circuit integrity is maintained. If the connection between the end of line resistors and the comparators is either opened or short circuited by an unauthorised person or by the detector, then an out of limit voltage will be detected by the comparators and an alarm condition will be registered. The emergency input EMG is normally open circuit and is triggered by shorting it to ground or common.

The mode switching circuit 9 includes a main switch input MSI, a remote switch input RSI, a home switch input HSI and a radio signal or wireless input WI arranged as shown. The main switch input MSI is the main overriding input having control over the other switch inputs and being connected to the usual key switch on a front panel of the alarm system. In the open state, the alarm system is in the off mode and in the closed state. The alarm system is armed. The remote switch input RSI provides the ability to include a remote control switch which is tamper proofed in the usual manner. When the main key switch is turned on, the terminating resistor of the remote switch input circuit is shorted out to fault the monitored open circuit input. Similarly, if an intruder were to cut or short this input line, the same result would be achieved. The remote switch input to the micro-processor unit 7 is verified 5 mS after the initial response before accepting the changed input state to ensure that the system will not return to an exit mode if the line from the remote switch is cut while the alarm system is armed.

The home switch input HSI allows the alarm system to be set such that a low volume entry tone will be sounded on the internal alarm horn 11 for a predetermined period, for example 30 seconds, before both the internal and external alarm horns are activated at full volume. This allows the user to deactivate the system in the event that the system is inadvertently tripped.

The alarm signal generated by the micro-processor unit 7 for the internal and external alarm horns 11 and 12 comprise amplifier circuits 13 and 14 for producing the mute signals and further amplifier circuits 15 and 16 for producing the loud alarm horn signals. Each alarm horn 11 and 12 is also provided with a tamper circuit comprising a gating diode from each horn output connected to ground. If the horn wires are cut the tamper input will latch and activate the alarm. A tamper switch is also associated with the main control panel and operates in the usual manner.

With the exception of the special features described in greater detail above, the operation of the alarm system is otherwise substantially standard. The alarm system includes the usual LED display panel which indicates the status of the systems, includes a special alarm sound when the fire input is triggered and includes an emergency input which overrides the other functions to sound both alarm horns at full volume. The usual bypass switches are provided to allow the system to be set up and tested by an installer or service man. The control panel may include a mute button which holds the alarm horns 11 and 12 in the mute mode during installation and testing or during an initial user familarization period. The system may also be arranged to render the alarm horns 11 and 12 inoperative where the system is connected to a telephone dialler.

Figure 3:
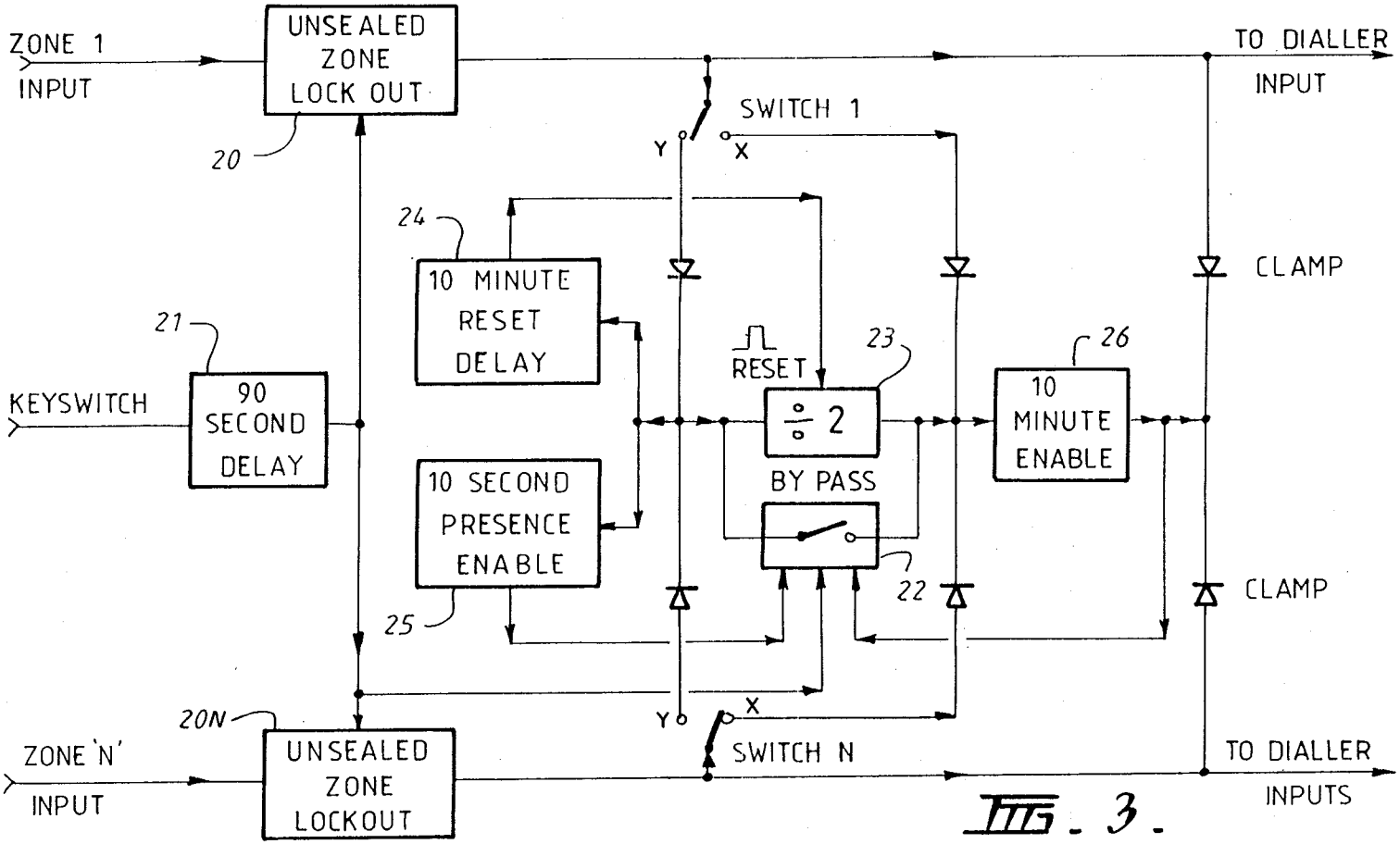
FIG. 3 is a block diagram of the first aspect of the invention applied to a dialler inhibiting device.

Referring now to FIG. 3, a telephone dialler inhibiting circuit embodying the invention is shown in block diagram form. It will be appreciated that the circuitry shown will be repeated for each of the N zones (usually eight) of the alarm system to which the dialler is to be fitted. The circuitry shown may be supplied as an accessory to be added to any alarm system having a dialler or the circuitry may form part of a dialler circuitry itself. In the latter case, the previously described embodiment may be modified to exclude the inhibit on the dialler input since this function would be performed by the dialler circuitry.

Referring to FIG. 3 each zones input connects through a respective unsealed zone lockout circuit 20-20N to prevent out of service (or faulted) zones from interfering with the correct operation of the system. During an off period and during the 90 second exit period a 90 second delay circuit 21 controls the lockout circuits 20-20N and the bypass switch circuit 22, allows the true state of each zone to be present at the dialler inputs so that true information about any zone can be interpreted during the testing of the complete alarm system including the dialler operation.

Switches 1 to N are provided to enable selection of acivation by a single or double trigger pulse input. A single trigger selection is used for one-shot input devices such as pressure mats, photo-electric beams, hold-up alarms and the like. All other detection devices usually produce two or more trigger pulses and are set in position y. When the switches 1 to N are in that position, a trigger from the alarm panel is received and is counted once by a divide by two counter 23 and starts a 10 minute reset delay circuit 24 and a 10 second presence enable circuit 25. The 10 minute reset delay circuit 24 resets the divider 23 after 10 minutes so that old stored information (e.g. random one-shot triggers) that potentially could remain for days or weeks is deleted. A 10 second presence enable circuit 25 discriminates against random one-shot triggers (usually less than 10 seconds) but looks for triggers that are longer than 10 seconds. Such triggers will be caused by broken window tape, forced doors fitted with reed switches and cut wires. Circuit 25 operates the bypass switch circuit 22 to bypass the divider 23. The output of divider 23 trips a 10 minute enable circuit 26 which unclamps (enables) all zone inputs to trigger their appropriate dialler inputs as applicable. Enable circuit 26 also operates bypass 22 which renders the divider 23 ineffective for the 10 minute period. Thus any activity, including one-shot events, are taken seriously and allow all information to be passed to the dialler.

It will be appreciated from the above that two random one-shot events have to occur within a 10 minute period for the dialler to operate and pass the information. Thus, the principle of operation of this circuit is essentially identical to that of the first embodiment described above.

The first embodiment described above may optionally be fitted with remote satellite alarm horns and a particularly prefered remote satellite alarm horn will now be described with reference to FIGS. 4 and 5 of the drawings.

As indicated above, it is usual for an alarm system to include an indoor and an outdoor alarm horn which is driven by an electronic siren generator controlled by the alarm system. This arrangement works well in most cases, but with increasing knowledge of alarm systems a trend is emerging whereby some intruders will cut the wires to the alarm horn or smash the control box and with some systems either action may result in the alarm sytem being rendered inoperative.

While satellite siren units which contain rechargeable batteries and a siren generator in the same remote box are known to overcome this problem, a problem with such satellite sirens is that when a mains power failure occurs, the back-up battery slowly discharges and the siren will be activated at a specific voltage thereby creating a false alarm. This problem is overcome by the satellite siren shown in FIGS. 4 and 5 of the drawings.

Figure 4:
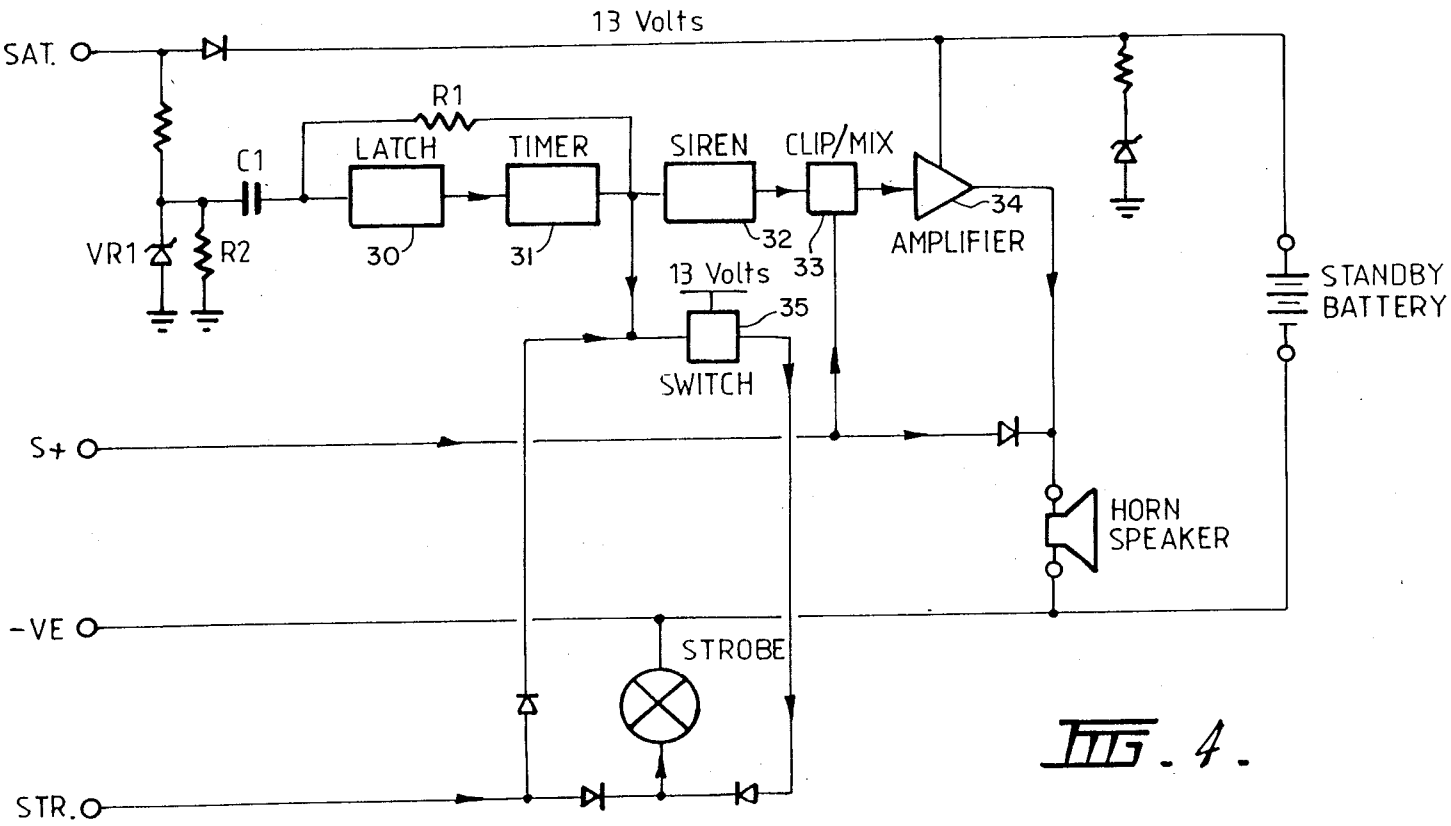
FIG. 4 is a block diagram of an embodiment of the third aspect of the invention.
Figures 5, 6:
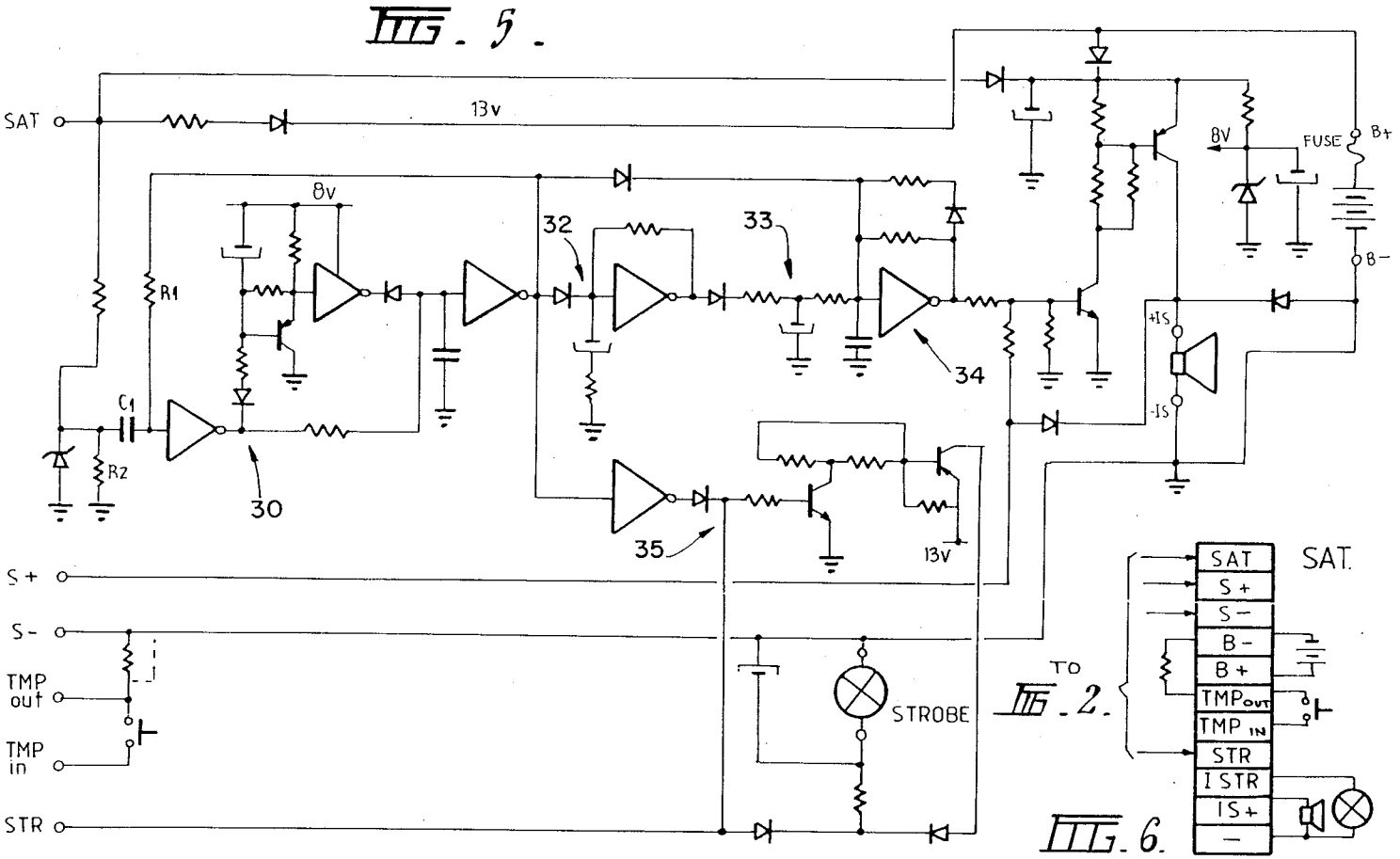
FIG. 5 is a detailed circuit diagram of the circuitry of FIG. 4.
FIG. 6 is a diagram showing the relationship between the detailed circuit diagram of FIG. 5 and the circuit of FIGS. 2A–2E.

Referring firstly to FIG. 4, the block diagram of the improved satellite siren will be seen to comprise a stand-by battery which is trickle charged by a voltage from the main alarm system via the terminals SAT and −VE. The voltages also apply to tamper detection circuitry comprising a latch 30, a time 31, a siren generating circuit 32 and 33 and amplifier 34. Sudden removal of the voltage causes the latch 30 to trigger the timer 31 which in turn activates the siren circuitry 32 to drive the horn speaker via the amplifier circuit 34.

In the event that the main power supply is disconnected either due to intentional disconnection or power failure the voltage of the remote battery will drop slowly. However, since this voltage is applied to the latch 30 via an RC coupled input, the time constant of which is very short (of the order of 100 mS), the slowly dropping voltage input will not trigger the latch thereby avoiding the creation of a false alarm.

VR1 provides a stable voltage pedestal of 8.2 volts, above which voltage electrical noise on the line will not falsely trigger the siren.

Another mode of operation in lieu of switching off the SAT input to trigger the siren is to directly connect the speaker output from the alarm panel to the S+ (speaker positive) terminal on the satellite module. This signal is then amplified by the amplifier 34. The advantage of this mode is that the satellite siren noise will be exactly the same as the indoor siren generated by the alarm panel, that is, synchronized.

Another feature is provided by clip/mixer 33. This allows low level tones from the alarm panel (as used for radio control alarm on/off confirmation) to sound at their originally intended volume through the satellite horn speaker without amplification, provided the level is below 3 volts.

If desired, a strobe light may be provided to serve as an additional warning to a returning occupant that an alarm has occurred. The strobe operation is exactly the same as the siren but requires an extra wire connected from the alarm panel to the SIR (strobe output) terminal. The duration of time the strobe operates for is controlled by the alarm panel, unless the wiring is cut, in which case the 10 minute siren timer will control the strobe operating time. Switch 35 provides the bulk of the current to the strobe when driven by the STR input from the alarm panel.

By using a tamper switch within the satellite box connected back to the alarm panel, additional security is gained if the wires are cut, this is because the indoor speakers (driven by the alarm panel) and dialler if used, are triggered, thus giving maximum deterrent effect.

I claim:

1. An alarm system comprising means for receiving at least one detection input signal adapted to cause activation of the alarm system, means for inhibiting activation of said alarm system when a first detection input signal is received and means for removing said inhibition and allowing activation of said alarm system when another detection input signal is received within a predetermined time of said first detection input signal's being received, a first alarm device located essentially indoors on the premises to be protected, a second alarm device located outdoors on the premises to be protected, said inhibition means allowing activation of said first alarm device only, said second alarm device being activated if a further detection input signal is received within said predetermined time.

2. The system of claim 1, wherein said alarm devices have a selectable on/off ratio which is preferably 1:7.

3. An alarm system comprising a plurality of sensors each having means for providing a detection input signal adapted to cause activation of the alarm system;

means for receiving a first detection input signal from any of said sensors;

means for inhibiting activation of said alarm system when said receiving means receives said first detection input signal; and means for removing said inhbition and allowing activation of said alarm system when said receiving means receives a second detection input signal, within a predetermined time of said first detection input signal, from any one of said plurality of sensors.

4. The system of claim 3, including means adapted to transmit an alarm signal to a remote location, said transmitting means being inhibited when said first detection input is received within a predetermined time of said first detection input and being activated when a further detection input signal is received indicating that a false alarm has not occurred.

5. The system of claim 1 or 4, wherein said predetermined time is of the order of five or ten minutes.

6. The system of claim 3, including circuit means for activating the alarm system in the event that said first detection input is of a duration greater than about five to ten seconds or in the event that said first detection input is from a one-shot detection device.

7. The system of claim 3, further comprising alarm horns and a selectable mute circuit which operates to reduce the voltage applied to the alarm horns and therefore the output from the horns for testing and for an initial familiarization period.

8. The system of claim 7, further comprising a selectable home mode circuit in which the alarm system is activated in the mute mode for an initial period of the order of thirty seconds.

9. A satellite alarm unit for a security system comprising an alarm means, a main power supply, a remote power supply, a power supply circuit for supplying power to said alarm means from either said main power supply or said remote power supply, and circuitry for detecting disconnection of or tampering with said unit, and circuit means for detecting an abrupt change in the voltage supplied by the main power supply to cause the alarm to be activated but which prevents activation of the alarm in the event that the voltage drops slowly, as would occur in the case of discharge of the remote power supply.

10. An alarm system including first and second alarm devices which are activated on detection of an intrusion or other event, said alarm system being arranged so that the cyclic outputs from said first and second alarm devices are out of phase by a predetermined amount.

11. The system of claim 10, wherein said outputs are 180° out of phase.

12. A security alarm system comprising:

alarm circuitry requiring a minimum predetermined voltage for proper functioning;

a back-up power supply having a voltage; and a shut-down circuit responsive to the voltage of the back-up power supply dropping below said predetermined voltage to deactivate the alarm system.

13. The system of claim 12 wherein said shut-down circuit includes a voltage comparator which compares a reference voltage with the voltage at the mid point of a voltage divider connected across the back-up power supply.

* * * * *